US007973226B2

(12) United States Patent
Towner

(10) Patent No.: US 7,973,226 B2
(45) Date of Patent: Jul. 5, 2011

(54) VIBRATO RETROFIT STRING TENSION KIT

(76) Inventor: Christian James Towner, San Diego, CA (US)

( * ) Notice: Subject to any disclaimer, the term of this patent is extended or adjusted under 35 U.S.C. 154(b) by 54 days.

(21) Appl. No.: 12/471,009

(22) Filed: May 22, 2009

(65) Prior Publication Data

US 2010/0294110 A1 Nov. 25, 2010

Related U.S. Application Data

(60) Provisional application No. 61/055,711, filed on May 23, 2008.

(51) Int. Cl.
*G10D 3/14* (2006.01)

(52) U.S. Cl. ..... 84/312 R
(58) Field of Classification Search ..... 84/312 R, 84/313, 289, 299, 307
See application file for complete search history.

(56) References Cited

U.S. PATENT DOCUMENTS 6,034,311 A * 3/2000 Fisher, IV ..... 84/313
2010/0011936 A1* 1/2010 Dennis ..... 84/313
* cited by examiner

*Primary Examiner* — Kimberly R Lockett

(57) ABSTRACT

A guitar sting tension device for an electrical guitar retrofitted with a vibrato unit to prohibit displacement of the strings on the bridge of the guitar consisting of a rotatable string retention bar, two rotatable connection arms, a pivotal anchor collar with recessed aperture; and a mounting adapter to affix the vibrato unit to the guitar.

9 Claims, 3 Drawing Sheets

VIBRATO RETROFIT STRING TENSION KIT

TECHNICAL FIELD

The present invention relates to optional effects for electrical guitars, in particular, the device allows for retrofitting a vibrato unit to an electric guitar.

BACKGROUND OF THE INVENTION

Electric guitars are sometimes manufactured with an optional vibrato unit to provide a mechanism that allows the guitarist to stretch or loosen the guitar strings while the guitar is being played. This provides a fanciful variation to the sounds of the guitar by allowing the guitar player to alter the pitch by moving the lever mechanism of the vibrato unit. In the past, if a guitar owner wanted a guitar with a vibrato unit, the owner would have to procure a guitar that was manufactured with such a vibrato.

A guitar owner may attempt to mount a vibrato unit by drilling holes in the deck of the guitar to screw on a vibrato unit. However this could affect the tone of the instrument and could also affect the structural integrity of the deck, especially in hollow bodied guitars, which have thin wooden decks. Additional holes in the guitar may also affect the value of the guitar. A guitar owner did not have a commercially available option to effectively add such a vibrato mechanism to an existing electric guitar.

On an ordinary guitar, the strings are held in place on the face of the guitar at the tailpiece. To retrofit a vibrato unit onto an electric guitar, the existing tailpiece, aft of the bridge, must be removed to accommodate the installation. This because the vibrato unit would then serve to hold in place the end of the strings. The removal of the tailpiece typically leaves either mounting bolts sticking up from the face of the guitar or holes in the deck. This is cosmetically degrading and affects the value of the guitar.

Also, the substitution of the vibrato unit for the tailpiece typically alters the length of the strings between the bridge and the terminal attachment point. For hollow bodied guitars, the length of the strings is greater with the vibrato unit than with the tailpiece. The strings also approach the bridge from there connection with the vibrato at a lesser angle than with the tailpiece. This results in lesser down force or tension, which further results in problems keeping the strings in place on the bridge when the vibrato unit is activated. It also affects the action of the strings at the neck. The lesser angle further provides problems retaining the stings on the bridge when the guitar is being played. The present invention provides a means for maintaining the proper tension on the strings with the proper angle as well.

Additionally, the removal of the tailpiece leaves either an unsightly set of holes or studs on the face of the guitar where the tailpiece was connected. Leaving holes in the guitar face will alter the tone of the instrument as well as provide an unsightly guitar.

Therefore, there exists a need to create a device that would allow the retrofitting of a vibrato mechanism to an electric guitar that provides downward tension on the strings and utilizes the former connection method of the discarded tailpiece.

SUMMARY OF THE INVENTION

The present invention provides an electric guitar string tension device including a rotatable retention bar to rest on the guitar strings, two rotatable support arms at each end of the retention bar, two pivotal attachment collars on the other end of the support arms and two connection bolts to affix the attachment collars to the electric guitar. In an alternate construction, the retention bar and support arms are fabricated as one piece.

In another embodiment a mounting bracket is utilized to affix a vibrato unit to the electric guitar including an attachment means.

In yet another embodiment, a kit combining the electric guitar string tension device together with a mounting bracket and assorted bolts, nuts and screws is contemplated.

DETAILED DESCRIPTION OF THE INVENTION

Figure 1:
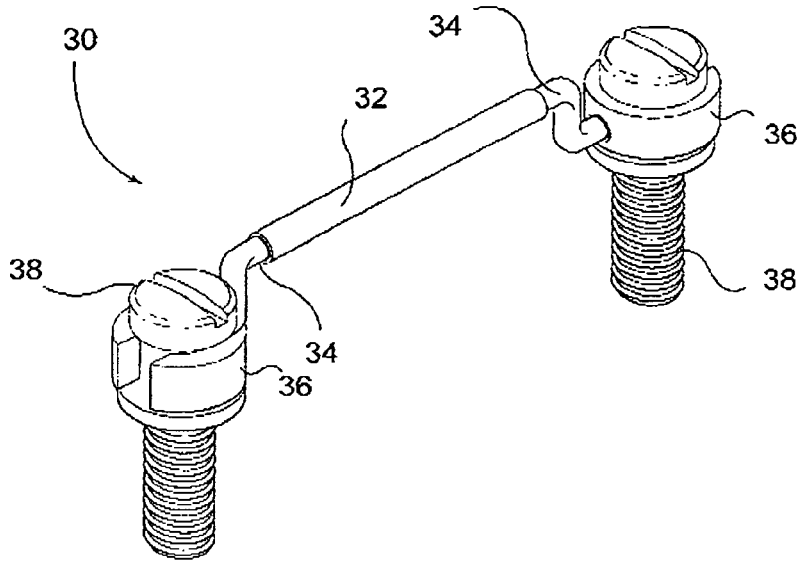
FIG. 1 is a perspective view of the assembled guitar string tension device.

Unless defined otherwise, all terms used herein have the same meanings as are commonly understood by one of skill in the art to which this invention belongs. All patent, patent applications and publications referred to throughout the disclosures herein are incorporated by reference in their entirety. In the event that there is a plurality of definitions for a term herein, those in this section prevail.

The term "attachment means" as used herein refers to a means for securely holding one component to another by a variety of methods known by one skilled in the art such as for example bolts and nuts to attach a vibrato unit to a mounting bracket.

The term "affixed" as used herein refers to a means for fastening or connecting, permanently or reversibly, one element of the invention to another element by a variety of methods know by one skilled in the art such as a bolt securing an annular collar onto a recessed threaded aperture on the face of a guitar.

The present invention of an electric guitar string tension device 30 contemplates a variety of device constructions including a retention bar 32 to rest on the guitar strings 16, two support arms 34 at each end of the retention bar 32, two pivotal attachment collars 36 on the other end of the support arms 34 and two connection bolts 38 to affix the attachment collars 36 to the guitar 10.

The component in contact with the guitar strings 16 is the retention bar 32. The retention bar 32 is held rotatably in place against the strings 16 by two support arms 34. In a preferred embodiment, the retention bar 32 is tubular and the support arms 34 are rods.

The retention bar 32 should be slightly longer than the distance between the first string on the guitar 10 and the last string as measured perpendicular to the length of the strings 16 near the bridge of the guitar 12. The inside diameter of the retention bar 32 should be slightly greater than the outside diameter of the support arms 34 to allow free rotational movement of the retention bar 32 yet close enough to be secure and not allow excessive movement.

The retention bar 32 may be constructed from a variety of materials known to one skilled in the art that provides sufficient strength and rigidity to prohibit excessive bending or flexing that may interfere with the operation of the string tension device 30. For example, the retention bar 32 may be constructed of metal, polymer plastic or high-density polymer. A preferred material is metal tubing.

Figure 4:
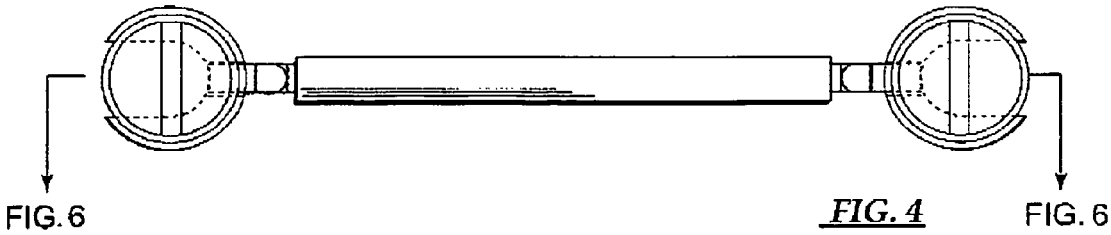
FIG. 4 is a plan view of the string tension device.
Figure 5:
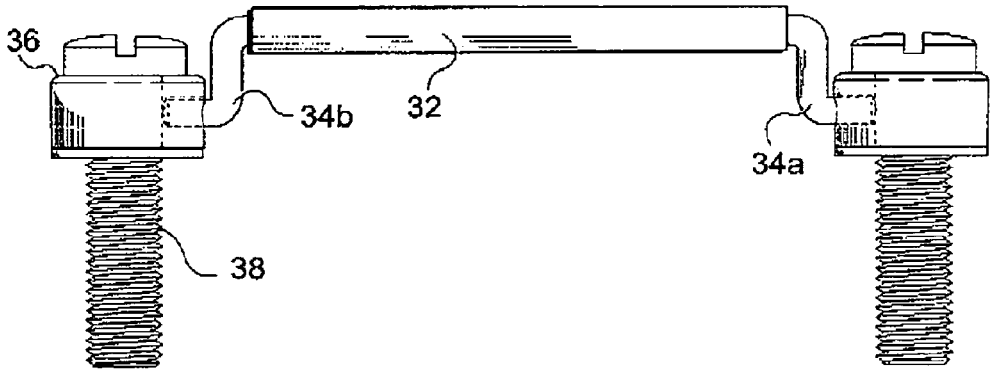
FIG. 5 is a full side view of the string tension device shown in FIG. 4.
Figure 6:
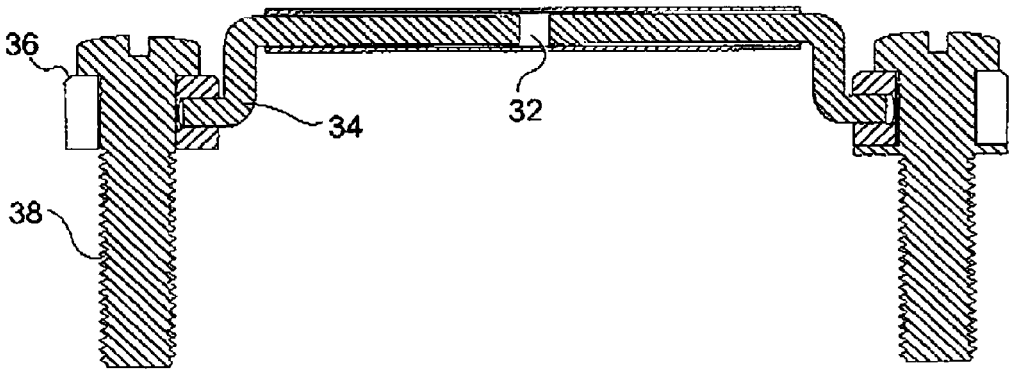
FIG. 6 is a cross-sectional view along line 6-6 of FIG. 4.

The support arms 34 may be constructed from solid rod material or hollow tubing material from a variety of materials known to one skilled in the art that provides sufficient strength and rigidity to prohibit excessive bending or flexing that may interfere with the operation of the string tension device 30. Preferably, the support arms 34 are constructed of metal rods. Each support arm 34 is bent at two locations resulting in two legs, one long leg and one short leg. The longer legs of the support arms 34 are bent inward relative to the retention bar 32 at approximately 90 degrees and the shorter legs are bent outward relative to the retention bar 32 at approximately 90 degrees in accordance with FIG. 4.

The outside diameters of the support arm 34 rods are slightly less than the inside diameter of the tubular retention bar 32. The longer legs of the support arms 34 are inserted into each end of the retention bar 32 during assembly. The lengths of the longer legs of the support arms 34 should be sufficient to provide strength to the assembled components yet not longer than approximately one half the length of the retention bar 32. The distance is known by one skilled in the art to be related to the distance between the two bolts or apertures 14 that served to hold the tailpiece in place before the tailpiece was removed to accommodate the string tension device 30.

The length of the support arms 34 between the two legs is determined by the amount of desired deflection of and tension on the strings 16. One skilled in the art could determine a desired length based on the desired angle of the strings 16 relative to the bridge 12. Such angle is critical to the invention as the greater the angle or the greater the tension, the more likely the strings 16 will remain on the bridge 12 as the guitar 10 is played.

One skilled in the art would recognize that the angle could also be adjusted by addition or removal of spacers under the annular collars 36. Preferred spacers would be annular washers.

The short legs of the support arms 34 are attached to the annular collars 36, each of which contain a recessed aperture. During assembly of the guitar string retention device 30, the shorter legs of the support arms 34 are inserted into the recessed apertures which are mounted with the apertures facing each other. The inside diameter of the recessed apertures of the annular collars 36 is slightly larger than the outside diameter of the rods used for the support arms 34 to allow for free movement of the support arms 34, yet close enough in diameter for the components to be securely held in place.

The annular collars 36 may be constructed from a variety of materials known to one skilled in the art that provides sufficient strength and ease of machining. For example, the annular collars 36 may be constructed of metal, polymer plastic or high-density polymer.

One skilled in the art would recognize that the inside diameter of the annular collars 36 should be slightly larger than the diameter of the affixing means such as connection bolts 38. There should be a tight fit to prevent any movement of the annular collars 36 once assembled. The outside diameter and height of the annular collars 36 should be sufficient to provide sufficient depth for the recessed apertures of the annular collars 36 to accommodate the short legs of the support arms 34.

An affixing means is necessary to attach the string tension device 30 to the electrical guitar 10. One skilled in the art would recognize that the optimal attachment method would utilize the same connection system that was used to affix the tailpiece to the guitar 10. Because the tailpiece is replaced by the vibrato unit 20, the string tension device 30 could easily adapt to the former connection. In one embodiment, the attachment means would be connection bolts 38 that match the thread pattern of the former tailpiece connection 14.

In another embodiment of the invention, the retention bar 32 and support arms 34 are constructed as one piece. In this configuration, the components could be cast or machined from metal.

Figure 2:
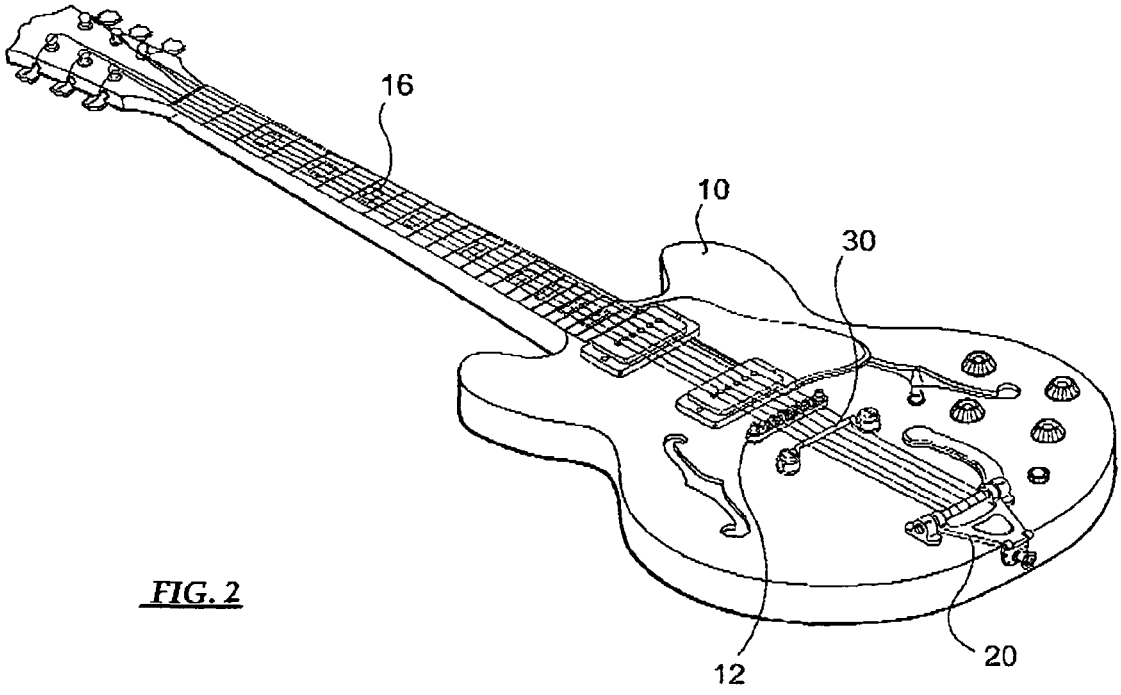
FIG. 2 is a perspective view of an electric guitar retrofitted with a vibrato unit with the string tension device installed in accordance with this invention.
Figure 3:
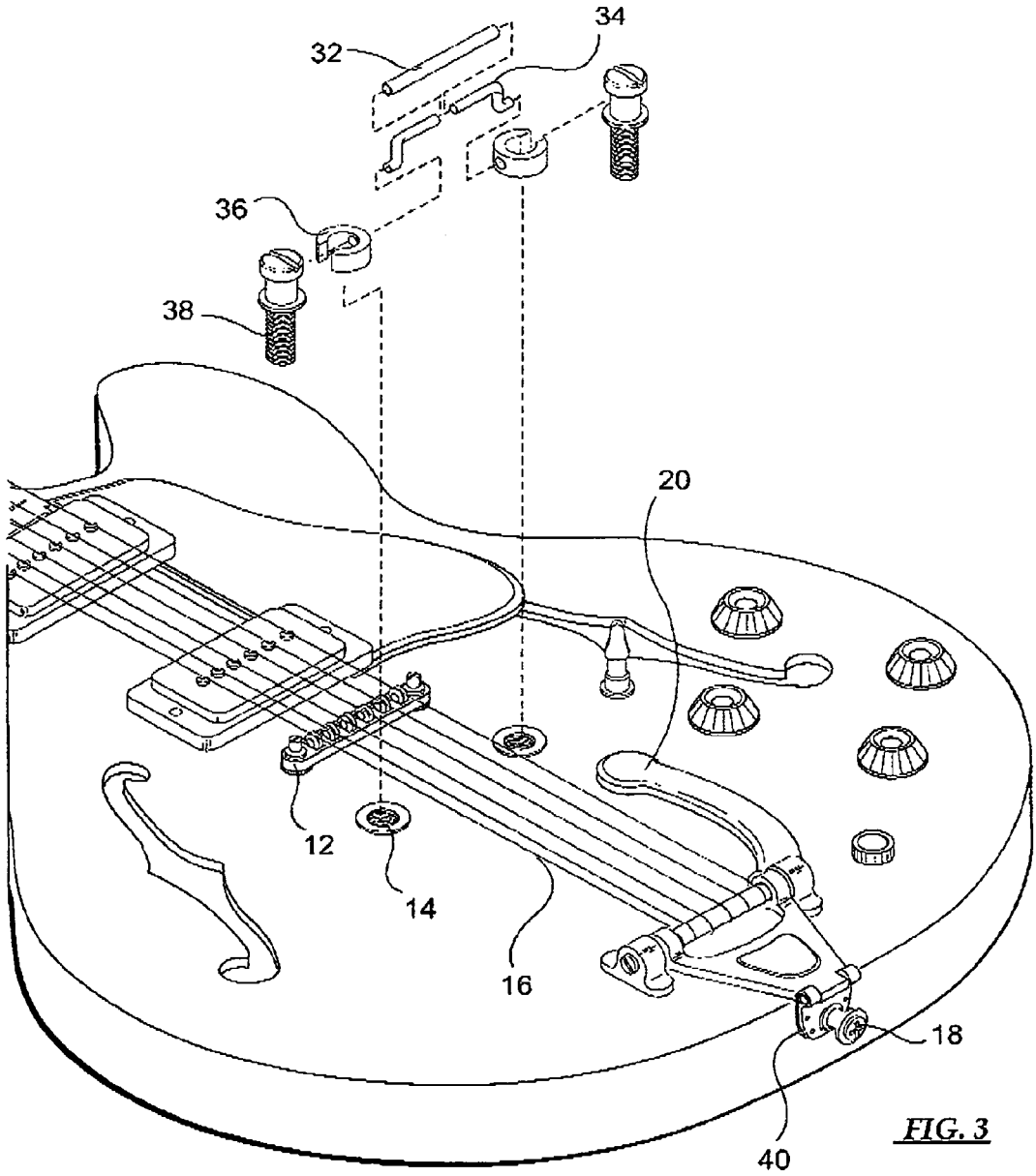
FIG. 3 is a partial perspective view of the guitar shown in FIG. 2 indicating how the components of the string tension device are assembled.

Another aspect of the invention is the mounting means of the vibrato unit 20. In one construction, a mounting bracket 40 may be used to affix the vibrato unit 20 to the electric guitar 10. In one embodiment, the mounting bracket 40 may be a L shaped configuration that mounts at the bottom tail bolt 18 of the electric guitar 10 in accordance with FIG. 2. The face of the connection bracket 40 may allow a multiplicity of apertures that match the mounting bolt pattern on the vibrato unit 20. An aperture located in the center of the connection bracket 40 may allow the tail bolt 18 to affix and secure the connection bracket 40. Bolts extending outwardly from the connection bracket may be utilized to mount the vibrato unit 20. The use of acorn nuts would provide a aesthetic installation. In another embodiment, screws may be used to affix the vibrato unit 20 to the guitar 10.

In yet another embodiment, a kit for installing a vibrato unit 20 may include the spring tension device 30, a connector bracket 40 custom fitted for specific vibrato units. connection bolts 38, assembly screws or bolts and acorn nuts.

I claim:

1. A device to provide tension on the strings of an electric guitar to restrain said electric guitar strings from dislocating from the bridge of said electric guitar when said electric guitar has been retrofitted with a vibrato unit and the tremolo bar of said vibrato unit is activated comprising:

a) A rotatable retention means to provide downward tension transversely across said electric guitar strings between the bridge and the vibrato unit of said electric guitar;

b) A rotatable connection means to pivotally restrain said rotatable retention means while reducing friction on said guitar strings;

c) A pivotal anchoring means to retain the connection means; and d) An attachment means to affix said anchoring means to said electric guitar.

2. The device of claim 1 wherein said rotatable retention means is tubular.

3. The device of claim 1 wherein said rotatable connection means consists of two rotatable support arms each with a vertical component and an upper component at a right angle to said vertical component facing inwardly to insert into the rotatable retention means and a lower component at a right angle to the vertical component, each of said support arms connecting to said rotatable retention means on opposing ends of said rotatable retention means.

4. The device of claim 1 wherein said pivotal anchoring means consists of two annular collars, each said annular collar to receive the associated rotatable connection means.

5. The annular collars of claim 4 including in each said annular collar a recessed aperture to receive said rotatable connection means.

6. The device of claim 1 wherein said attachment means consists of two adapters that affix said device to said electrical guitar.

7. The connectors of claim 6 wherein said adapters are the two bolts that are removed when a tailpiece of an electric guitar has been removed to accommodate a vibrato unit.

8. A device according to claim 1 wherein said rotatable retention means and said rotatable connection means are one piece.

9. A kit consisting of the device according to claim 1, a multiplicity of bolts to affix said device to an electric guitar with alternate thread patterns for differing tailpiece apertures, instructional manual, spare parts and a plurality of rotatable connectors with different lengths to accommodate dissimilar guitar specifications.

* * * * *